US010857561B2

(12) United States Patent
Horning et al.

(10) Patent No.: US 10,857,561 B2
(45) Date of Patent: Dec. 8, 2020

(54) SPRAYER HOPPER SHAKER

(71) Applicant: Graco Minnesota Inc., Minneapolis, MN (US)

(72) Inventors: Jeromy D. Horning, Albertville, MN (US); Thomas E. Pauly, Zimmerman, MN (US); Steven R. Kuczenski, New Brighton, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 423 days.

(21) Appl. No.: 15/871,474

(22) Filed: Jan. 15, 2018

(65) Prior Publication Data

US 2018/0207666 A1 Jul. 26, 2018

Related U.S. Application Data

(60) Provisional application No. 62/450,979, filed on Jan. 26, 2017.

(51) Int. Cl.

| | |
|---|---|
| ***B05B 15/20*** | (2018.01) |
| ***B05B 7/14*** | (2006.01) |
| ***B01F 11/00*** | (2006.01) |
| ***B01F 3/12*** | (2006.01) |
| ***B65D 88/66*** | (2006.01) |
| *B05B 13/00* | (2006.01) |

(52) U.S. Cl.

CPC ..... *B05B 15/20* (2018.02); *B01F 3/1242* (2013.01); *B01F 11/008* (2013.01); *B05B 7/1431* (2013.01); *B05B 7/1445* (2013.01); *B65D 88/66* (2013.01); *B01F 2215/0047* (2013.01); *B05B 13/005* (2013.01)

(58) Field of Classification Search

CPC ..... B65D 88/66; B05B 7/1445; B65G 27/24

See application file for complete search history.

(56) References Cited

U.S. PATENT DOCUMENTS

| | | | |
|---|---|---|---|
| 2,229,037 | A | 1/1941 | Boldman |
| 2,323,864 | A | 7/1943 | Weyandt |

(Continued)

FOREIGN PATENT DOCUMENTS

| | | | |
|---|---|---|---|
| DE | 1750626 | A1 | 4/1972 |
| WO | WO2015040174 | A1 | 3/2015 |

OTHER PUBLICATIONS

Extended European Search Report for EP Application No. 18250004.1, dated May 23, 2018, 8 Pages.

*Primary Examiner* — Elizabeth Insler

(74) *Attorney, Agent, or Firm* — Kinney & Lange, P.A.

(57) ABSTRACT

A material sprayer includes a hopper and a shaker assembly mounted onto a sidewall of the hopper. The hopper includes at least one sidewall that extends along a first plane. The shaker assembly includes a resilient bracket, an electromagnetic coil, and an armature. The resilient bracket is mounted to the sidewall of the hopper and includes first and second ends and a curved portion. The electromagnetic coil is mounted to a portion of the resilient bracket and is configured to generate a magnetic field in response to a current from a power source. The armature is mounted to a portion of the resilient bracket such that the armature is able to move relative to the electromagnetic coil along an acceleration axis that is orthogonal to the first plane of the sidewall of the hopper.

20 Claims, 6 Drawing Sheets

(56) References Cited

U.S. PATENT DOCUMENTS

| | | | | |
|---|---|---|---|---|
| 2,583,862 | A | 1/1952 | Lichtenstein | |
| 2,737,129 | A | 3/1956 | Johnson et al. | |
| 2,918,590 | A | 12/1959 | Gilbert | |
| 2,997,158 | A * | 8/1961 | Moskowitz ..... | B65G 27/24<br>198/769 |
| 3,106,652 | A | 10/1963 | Burt | |
| 3,575,620 | A | 4/1971 | Braden | |
| 3,724,755 | A | 4/1973 | Diamond et al. | |
| 3,733,500 | A | 5/1973 | Mushrush | |
| 3,976,332 | A | 8/1976 | Fabel | |
| 4,021,022 | A | 5/1977 | Satterfield, III et al. | |
| 4,052,004 | A | 10/1977 | Martin et al. | |
| 4,408,889 | A | 10/1983 | Peschl | |
| 6,220,791 | B1 | 4/2001 | Hutchins | |

* cited by examiner

SPRAYER HOPPER SHAKER

BACKGROUND

The present disclosure relates to material sprayers. More particularly, the present disclosure relates to a shaker assembly for a hopper of a material sprayer.

Material sprayers are used to spray fluid to build up and/or cover surfaces such as walls and ceilings, with the fluid drying in place to form a solid material. The sprayed fluids are typically viscous and can include plaster, aggregate (e.g., polystyrene or vermiculite), wall and ceiling texture materials, joint compounds, surfacing materials, acrylic materials, textured elastomeric materials, and coating materials (e.g., anti-skid floor coating materials). Material for the sprayer is typically supplied in bags or buckets, mixed with water if necessary, fed into the sprayer, placed under pressure by a pump of the sprayer, and then sprayed from a gun or other outlet.

SUMMARY

A material sprayer includes a hopper and a shaker assembly mounted onto a sidewall of the hopper. The hopper includes at least one sidewall that extends along a first plane. The shaker assembly includes a resilient bracket, an electromagnetic coil, and an armature. The resilient bracket is mounted to the sidewall of the hopper and includes first and second ends and a curved portion. The electromagnetic coil is mounted to a portion of the resilient bracket and is configured to generate a magnetic field in response to a current from a power source. The armature is mounted to a portion of the resilient bracket such that the armature is able to move relative to the electromagnetic coil along an acceleration axis that is orthogonal to the first plane of the sidewall of the hopper.

A shaker assembly for a hopper of a material sprayer includes a resilient bracket, an electromagnetic coil, and an armature. The resilient bracket includes a first end, a curved section connected to the first end, and a second end attached to the curved section. A portion of the curved section is out of plane with at least one of the first end and the second end. The electromagnetic coil is mounted to a portion of the resilient bracket and is configured to generate a magnetic field in response to a current from a power source. The armature is mounted to a portion of the resilient bracket such that the armature is able to move relative to the electromagnetic coil.

A shaker assembly for a hopper of a material sprayer includes a mounting plate mounted to the hopper, a J-shaped bracket, an electromagnetic coil, an armature, and a U-shaped bracket. The J-shaped bracket includes a first end and a second end. The first end of the J-shaped bracket is mounted to the mounting plate. The electromagnetic coil is mounted to a portion of the J-shaped bracket and is configured to generate a magnetic field in response to a current from a power source. The armature is mounted to a portion of the J-shaped bracket such that the armature is able to move in an oscillating motion relative to the electromagnetic coil. The U-shaped bracket is mounted to the mounting plate and comprises two legs that are disposed on opposite sides of the armature and of the electromagnetic coil.

DETAILED DESCRIPTION

Figure 1:
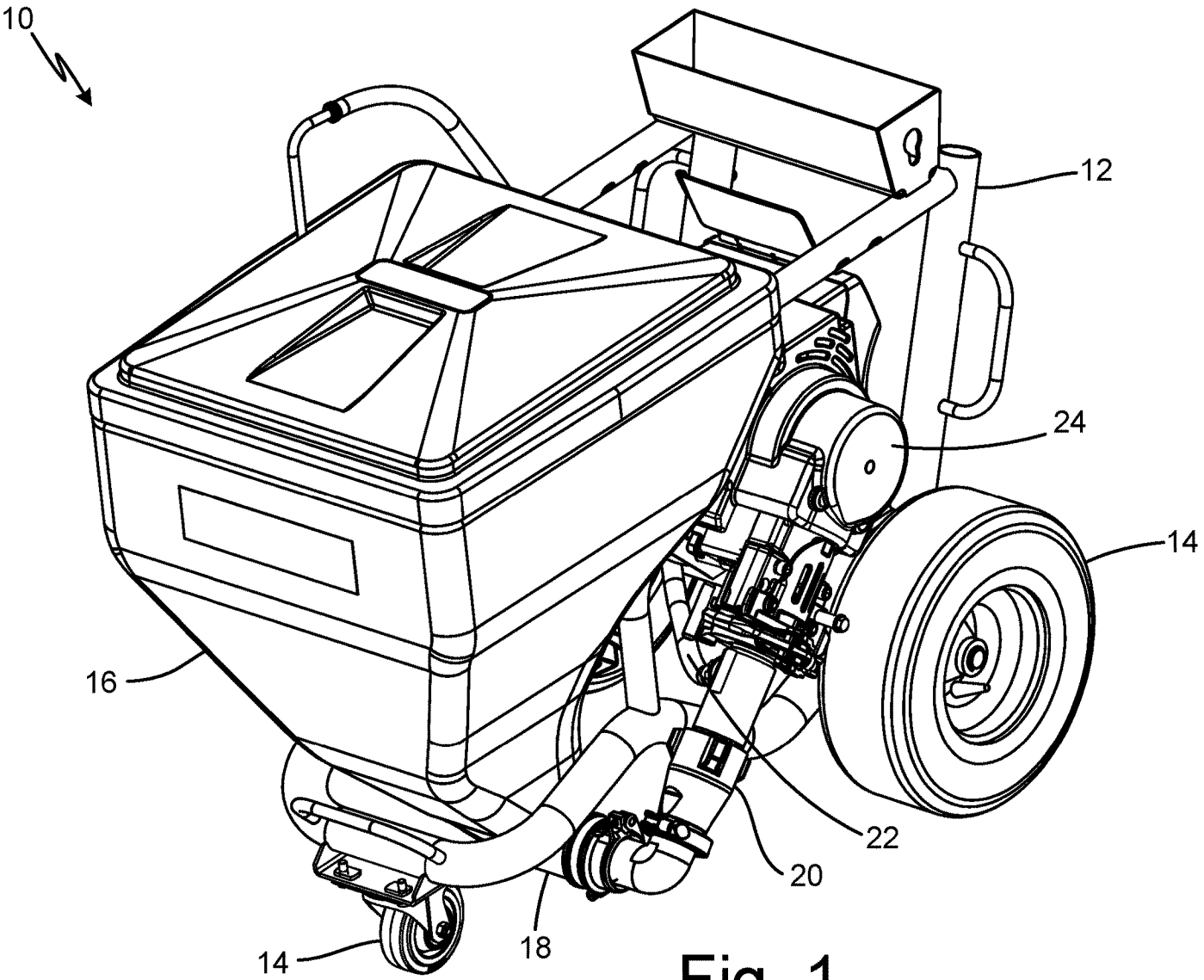
FIG. 1 is an isometric view of a material sprayer with a motor and a hopper.

FIG. 1 is an isometric view of material sprayer 10 and shows frame 12, wheels 14, hopper 16 (with port 18), pump 20, hose 22, and drive motor 24 for spraying liquid material. Material sprayer 10 is a modular unit that can be maneuvered around a job site as needed. Frame 12 is disposed throughout material sprayer 10 and is connected to the various elements of material sprayer 10 such as wheels 14, hopper 16, pump 20, and drive motor 24. Wheels 14 are mounted to frame 12 via an axle. Hopper 16 is mounted to a portion of frame 12. Port 18 is disposed on a gravitational bottom portion of hopper 16 (towards the bottom of FIG. 1). Port 18 is connected to hopper 16 and fluidly connected to pump 10. Port 18 is also fluidly connected to a cavity of hopper 16. Pump 20 is fluidly connected to port 18 of hopper 16. Pump 20 is also mechanically connected to drive motor 24. Hose 22 is fluidly connected to an internal chamber of pump 20. Drive motor 24 is mounted to frame 12 and is mechanically connected to pump 20.

Material sprayer 10 is configured to spray a pressurized fluid onto a surface. Frame 12 holds together and supports all of the elements of material sprayer 10. Wheels 14 rotate enabling material sprayer 10 to be moved around to new locations. Hopper 16 contains material within hopper 16. During operation of material sprayer 10, hopper 16 guides the material within hopper 16 in a downward direction to port 18. Port 18 transports the fluid from hopper 16 to pump 20. Pump 20 pressurizes the fluid received from hopper 16 and delivers the pressurized fluid to hose 22. Hose 22 transports the pressurized fluid away from pump 20 to a spray handle or other fluidic outlet. Drive motor 24 is driven to cause pump 20 to create a pressure within pump 20.

During operation of material sprayer 10, material within hopper 16 can adhere to the inner walls of hopper 16 such that all of the material in hopper does not exit hopper 16 into pump 20. Existing methods or strategies to move this residual material from hopper 16 into port 18 include the operator manually scraping the inner walls to remove material from the walls of hopper 16. This manual scraping is often an inefficient and inconsistent means of removing material from the walls of hopper 16.

Figure 2A:
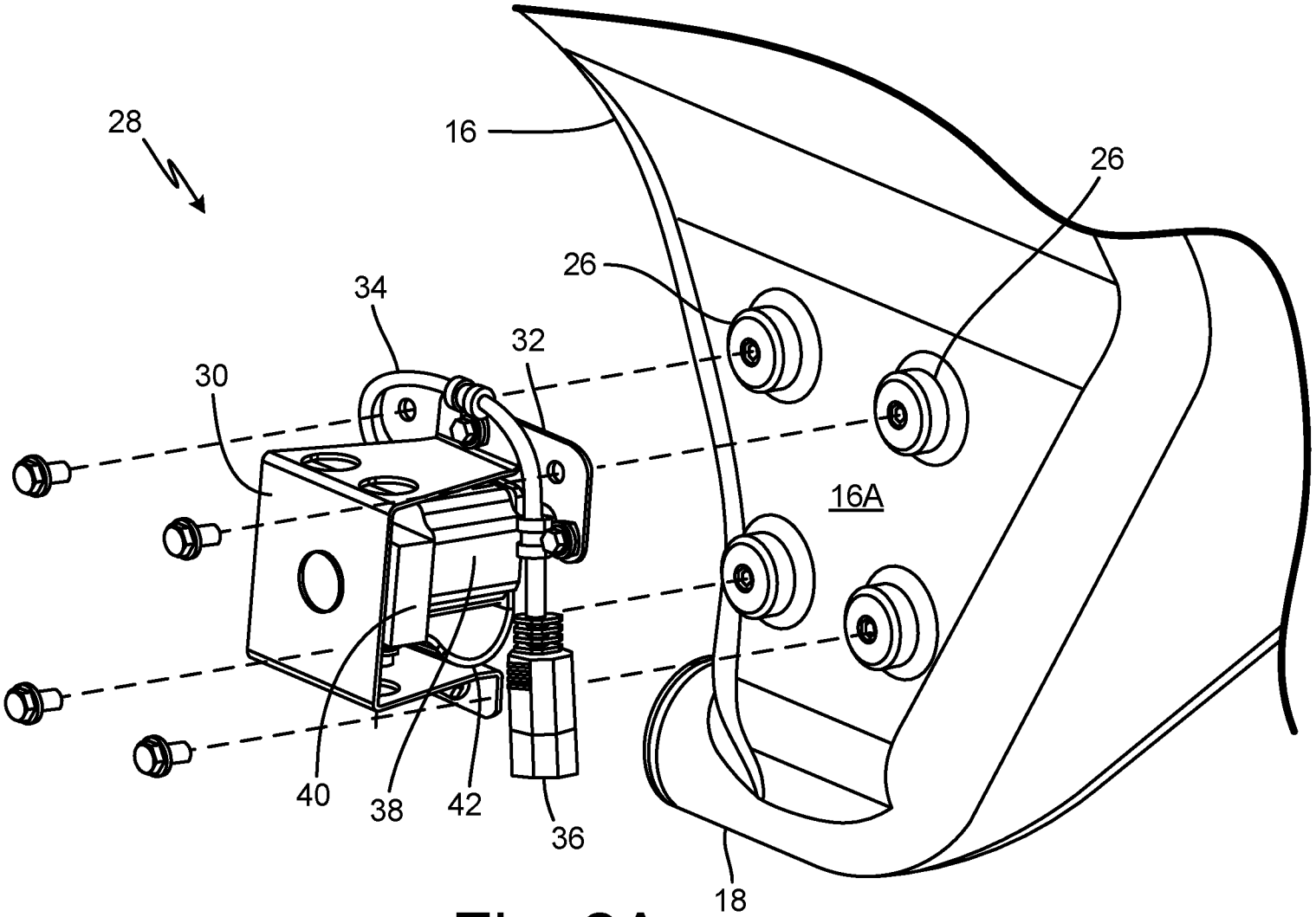
FIG. 2A is a partially exploded perspective view of the shaker assembly and the hopper.
Figure 2B:
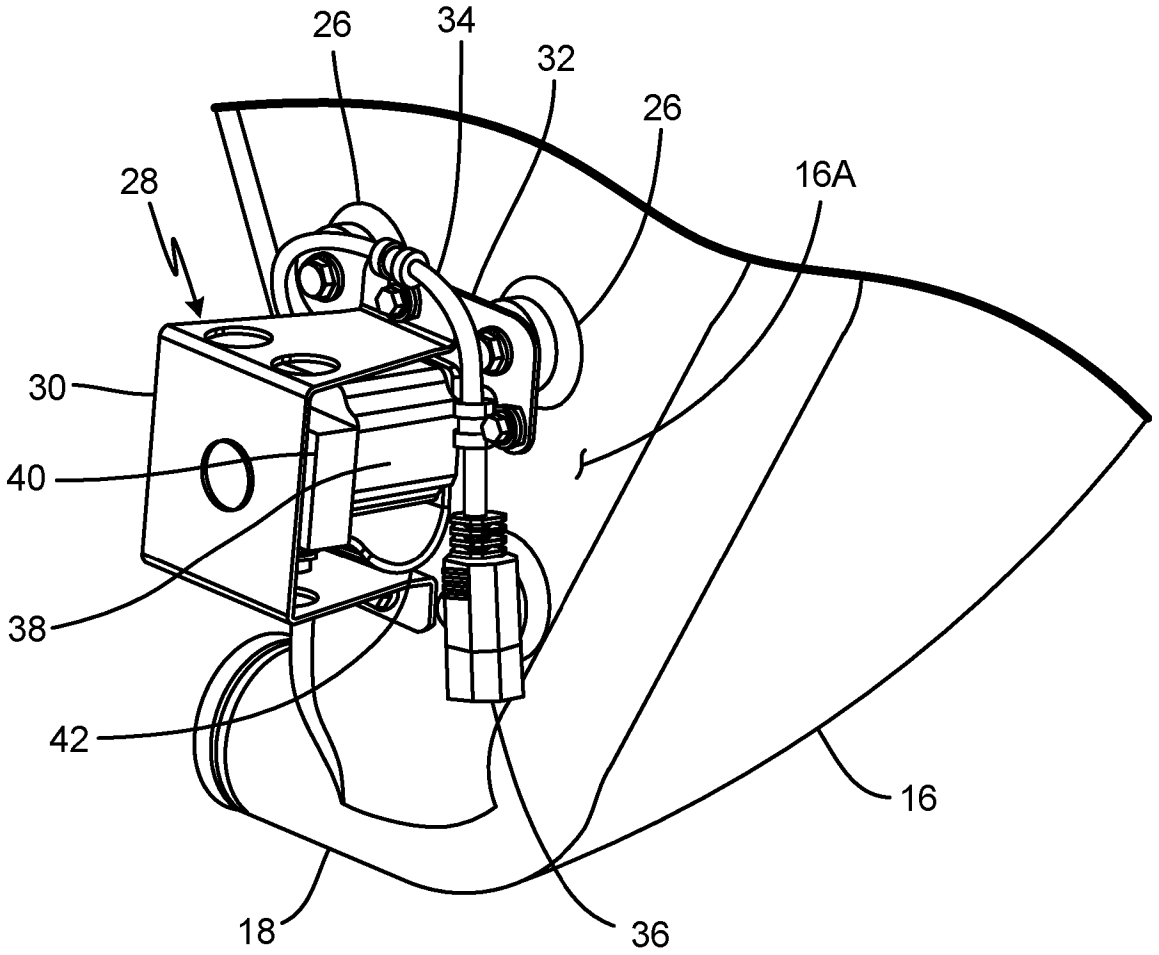
FIG. 2B is a perspective view of the shaker assembly mounted to a portion of the hopper.

FIG. 2A is a partially exploded perspective view of hopper 16 (with sidewall 16A, port 18, and receivers 26) with shaker assembly 28 and shows shaker assembly 28 with amplifier bracket 30, mounting plate 32, electrical cord 34, receptacle 36, electromagnetic coil 38, armature 40, and resilient bracket 42. FIG. 2A shows shaker assembly 28 detached from hopper 16. FIG. 2B is a perspective view of hopper 16 (with port 18 and receivers 26) with shaker assembly 28 mounted to a portion of hopper 16. Shaker assembly 28 is shown in an assembled state in FIG. 2B. FIGS. 2A and 2B include the same or similar elements and will be discussed in unison.

Sidewall 16A is side wall of hopper 16. Receivers 26 are protrusions of solid material. Each of receivers 26 includes a threaded recess. In one non-limiting embodiment, receivers 26 can be formed from metal. In another non-limiting embodiment, receivers 26 can be structurally similar to nuts, in that receivers 26 receive and threadably attach to threaded bolts. Shaker assembly 28 is an assembly including amplifier bracket 30, mounting plate 32, electrical cord 34, receptacle 36, electromagnetic coil 38, armature 40, and resilient bracket 42. Amplifier bracket 30 is a U-shaped bracket. In another non-limiting embodiment, bracket 30 can be referred to as a vibration-amplifying bracket (e.g., a second vibration-amplifying bracket). Mounting plate 32 is a thin, flat sheet of solid material such as metal. In one non-limiting embodiment, a material of mounting plate 32 can include stainless steel. In another non-limiting embodiment, mounting plate 32 can be referred to as a vibration-amplifying bracket (e.g., a first vibration-amplifying bracket).

Electrical cord 34 is a sheathed cable configured to transport electric current. Receptacle 36 is an electrical socket such as an International Electrotechnical Commission receptacle. Electromagnetic coil 38 is an electromagnetic coil assembly and includes a housing or casing surrounding a wire winding (not shown) configured to generate an electromagnetic field when a current is conducted through the wire winding. Armature 40 is a block of metal such as iron or another ferromagnetic material. Resilient bracket 42 is a thin J-shaped piece of solid material. In one non-limiting embodiment resilient bracket 42 can be formed from metal, such as stainless steel.

Receivers 26 are connected to and extend outward from sidewall 16A of hopper 16. In this non-limiting embodiment, receivers 26 are molded into sidewall 16A of hopper 16. Shaker assembly 28 is mounted to sidewall 16A of hopper 16 via bolted attachment with receivers 26. Mounting plate 32, electromagnetic coil 38, armature 40, resilient bracket 42, and amplifier bracket 30 form a stack. Resilient bracket 42 forms a first end of the stack and mounting plate 32 forms a second end of the stack. Amplifier bracket 30 is mounted to mounting plate 32 with nuts and bolts. Mounting plate 32 is mounted to receivers 26 of hopper 16. Mounting plate 32 is also attached to amplifier bracket 30, electromagnetic coil 38, and resilient bracket 42 via bolted engagement. Electrical cord 34 is electrically connected to electromagnetic coil 38. Receptacle 36 is disposed on an end of electrical cord 34. In one non-limiting embodiment, receptacle 36 is electrically connected to a power cord (not shown) from a controller of material sprayer 10.

Electromagnetic coil 38 is positioned in shaker assembly 28 between a portion of armature 40 and resilient bracket 42. Electromagnetic coil 38 is mounted to resilient bracket 42 with bolts passing through mounting plate 32 and through resilient bracket 42. Electromagnetic coil 38 is powered by a power source such as electrical cord 34. In another non-limiting embodiment, electromagnetic coil 38 can be connected to a battery. Armature 40 is positioned in shaker assembly 28 between a portion of amplifier bracket 30 and a portion of electromagnetic coil 38. Armature 40 is mounted to a portion of resilient bracket 42 such that armature 40 is able to move in an oscillating motion relative the electromagnetic coil 38. Resilient bracket 42 is positioned in shaker assembly 28 and is mounted to mounting plate 32 via bolted engagement.

Receivers 26 are configured to receive a fastener for affixing mounting plate 32 to sidewall 16A of hopper 16. Shaker assembly 28 is configured to cause hopper 16 to shake or vibrate in order to loosen material along the inner walls of hopper 16. Amplifier bracket 30 surrounds a portion of shaker assembly 28 thereby protecting and shielding shaker assembly 28 from undesirable debris. In one non-limiting embodiment, amplifier bracket 30 is configured to amplify an amplitude of oscillation of armature 40. In another non-limiting embodiment, amplifier bracket 30 is configured to damp the amplitude of oscillation of armature 40. Mounting plate 32 mounts shaker assembly 28 as a single unit to sidewall 16A of hopper 16. Electrical cord 34 carries an electric current to electromagnetic coil 38. In one non-limiting embodiment, the current (or signal) conducted along electrical cord 34 could be an alternating current signal output by a conventional electrical outlet. The negative portion of the signal may be chopped by a diode and the rest of the signal may be reduced in voltage by one or more resistors (not shown). Receptacle 36 is used to connect electromagnetic coil 38 to a power source.

Electromagnetic coil 38 generates an electromagnetic field when an alternating signal is conducted through the wire winding of electromagnetic coil 38. The alternating nature of the signal means that the electromagnetic field of electromagnetic coil 38 is generated and collapsed in time with a frequency of the signal. In one non-limiting embodiment, the frequency of the signal can be 50-60 times a second depending on the frequency of the input signal. Establishing and then collapsing the electromagnetic field of electromagnetic coil 38 is referred to herein as the electromagnetic field cycle, with each cycle comprising a first phase in which the electromagnetic field is strong enough to move armature 40 with respect to electromagnetic coil 38 and a second phase in which the electromagnetic field is entirely diminished or otherwise not strong enough to move armature 40 with respect to electromagnetic coil 38. During the second phase, a resilient or spring-like effect of resilient bracket 42 counteracts the movement of armature 40 from the first phase.

A magnetic force is applied to armature 40 from the electromagnetic field generated by electromagnetic coil 38. Generally, the electromagnetic field generated pulls armature 40 toward electromagnetic coil 38. An air gap exists between armature 40 and electromagnetic coil 38 to allow armature 40 to move towards electromagnetic coil 38 in response to the electromagnetic field generated by electromagnetic coil 38. During the motion of armature 40, each of mounting plate 32, resilient bracket 42, and amplifier bracket 30 act as spring elements and flex due to acceleration of armature 40 toward electromagnetic coil 38. Mounting plate 32, resilient bracket 42, and amplifier bracket 30 spring back toward their nominal states when the electromagnetic force of electromagnetic coil 38 diminishes. The spring action of mounting plate 32, resilient bracket 42, and amplifier bracket 30 moves armature 40 back towards its nominal position with respect to electromagnetic coil 38 during each electromagnetic field cycle. It is noted that the nominal states of mounting plate 32, resilient bracket 42, and amplifier bracket 30 as well as the nominal position of armature 40 with respect to electromagnetic coil 38 will not be maintained while shaker assembly 28 is being driven to shake by the power signal because the components will be in constant cyclic motion, and/or possibly in a resonant state. Moreover, the spring action of mounting plate 32, resilient bracket 42, and amplifier bracket 30 may overshoot the nominal position of armature 40 with respect to electromagnetic coil 38.

Molding receivers 26 into the wall of the hopper 16 avoids having any mounting components exposed on the inside of the hopper 16, which would otherwise come into contract with the fluid in the hopper 16. Receivers 26 also avoid requiring holes extending through the side of hopper 16, which would complicate cleaning and risk leaking material out of or into hopper 16. Amplifier bracket 30 increases or decreases the vibration of shaker assembly 28 without requiring more power by integrating a flexible mass and spring-like effect into the design of amplifier bracket 30. The design of shaker assembly 28 with amplifier bracket 30 and resilient bracket 42 provides additional vibration as compared to existing vibrating feeder coil designs. The curved J-shape of resilient bracket 42 allows for more deflection of armature 40 with a longer life and less power as compared to existing spring plates or brackets with sharp 90 degree angles.

Figure 3:
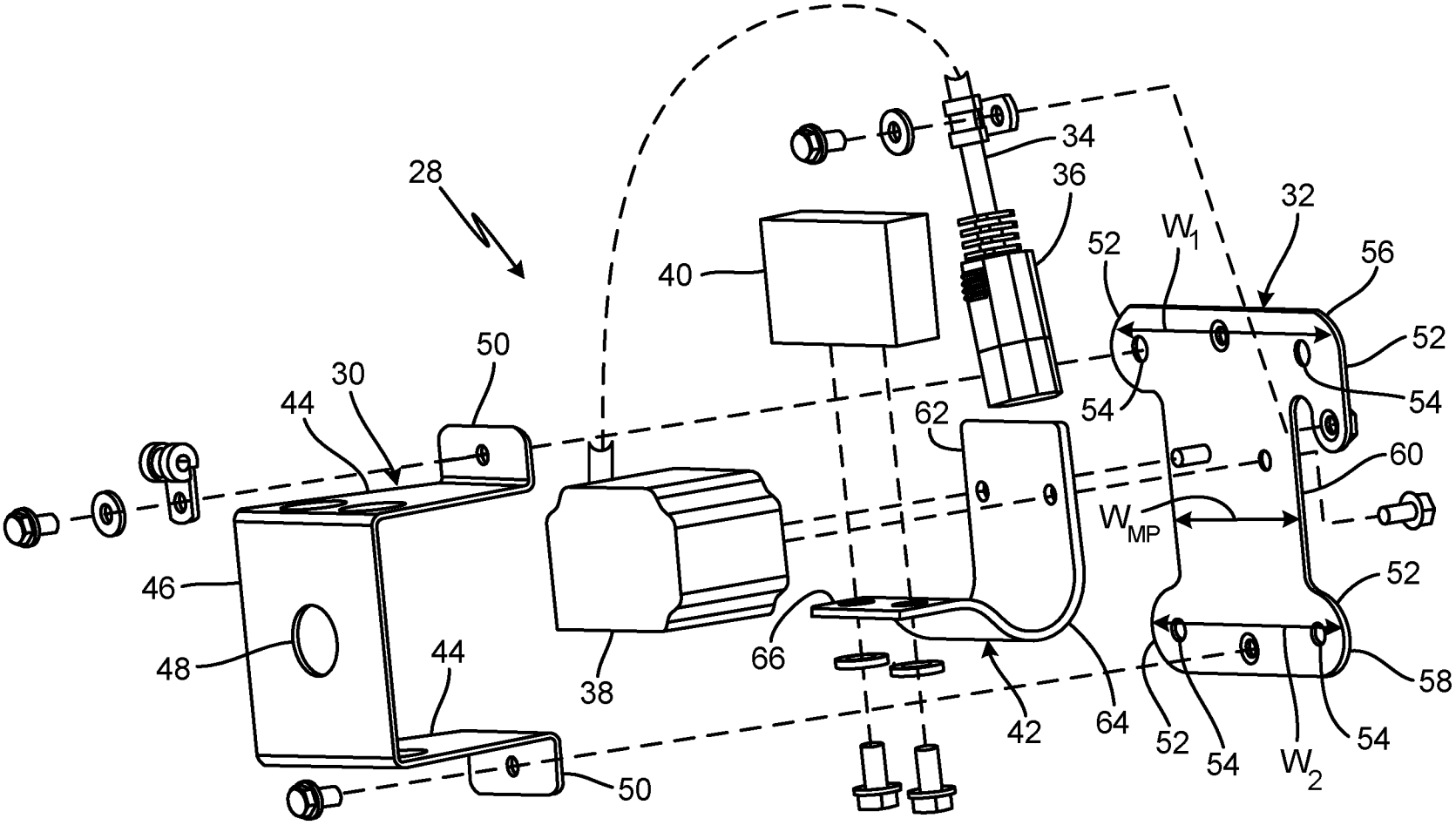
FIG. 3 is an exploded, assembly view of the shaker assembly.

FIG. 3 is an exploded, assembly view of shaker assembly 28 that shows amplifier bracket 30 (with legs 44, back panel 46, opening 48, and feet 50), mounting plate 32 (with tabs 52, holes 54, first end 56, width $W_1$ of first end 56, second end 58, width W2 of second end 58, middle portion 60, and width $W_{MP}$ of middle portion 60), electrical cord 34, receptacle 36, electromagnetic coil 38, armature 40, and resilient bracket 42 (with first end 62, curved portion 64, and second end 66).

Legs 44, back panel 46, and feet 50 are flat sheets of solid material. Opening 48 is a hole or cut-out. In this non-limiting embodiment, opening 48 is a single, circular hole. In other non-limiting embodiments, opening 48 can include other shapes and different quantities of openings. Tabs 52 are flat extensions of solid material. Holes 54 are openings or cut-outs. First end 56, second end 58, and middle portion 60 are flat sheets of solid material. Width $W_1$ is a width of first end 56. Width $W_2$ is a width of second end 58. Width $W_{MP}$ is a width of middle portion 60. First end 62 and second end 66 are flat pieces of solid material. Curved portion 64 is a curved sheet of solid material.

Each of electromagnetic coil 38 and armature 40 include respective threaded holes which accept bolts extending through holes in first and second ends 62, 66 of resilient bracket 42 to secure electromagnetic coil 38 and armature 40 to the first and second ends 62, 66, respectively. Legs 44 are connected to and extend away from back panel 46. In this non-limiting embodiment, legs 44 include two legs extending from back panel 46. In other non-limiting embodiments, legs 44 can include more than two legs 44. Each of legs 44 are positioned on opposites sides of electromagnetic coil 38 and armature 40. Back panel 46 is connected to and extends between legs 44. Back panel 46 is disposed on a side of armature 40 opposite from electromagnetic coil 38. Opening 48 is disposed in a portion of back panel 46. In other non-limiting embodiments, one or more openings can be disposed in other portions of amplifier bracket 30 such as in legs 44 or feet 50. Feet 50 connect to and are located on ends of legs 44.

Tabs 52 are connected to and extend from first and second ends 56 and 58 of mounting plate 32. Tabs 52 are located at the four corners of mounting plate 32. Holes 54 are disposed in and extend through portions of mounting plate 32. Holes 54 are generally located at the four corners of mounting plate 32. First end 56 and second end 58 are opposite ends of mounting plate 32. In this non-limiting embodiment, width $W_{MP}$ of middle portion 60 is less than width $W_1$ of first end 56 and less than width W2 of second end 58. Middle portion 60 is connected to and disposed between first and second ends 56 and 58 of mounting plate 32. First end 62 and second end 66 are opposite ends of resilient bracket 42. First end 62 and second end 66 are connected to and extend from curved portion 64. Curved portion 64 is connected to and disposed between first and second ends 62 and 66 of resilient bracket 42 (see also FIG. 5 for further discussion of resilient bracket).

Legs 44 attach and connect feet 50 to amplifier bracket 30. Back panel 46 attaches and connects legs 44 to amplifier bracket 30. Legs 44 and back panel 46 add to the overall mass of shaker assembly 22. Opening 48 provides a reduction in mass of amplifier bracket 30. The quantity, size, and shape of opening 48 can be adjusted to adjust the weight of amplifier bracket 30 thereby altering the amplification (or dampening) effects of amplifier bracket 30 on shaker assembly 28. Bolts extend through holes in feet 50 and further extend through holes 54 in mounting plate 32 and are secured by nuts.

Tabs 52 widen mounting plate 32 at first and second ends 56 and 58 while forming a relatively narrower middle portion 60 therebetween. Because mounting plate 32 is wider at first and second ends 56 and 58 and narrower therebetween (at its middle portion 60), the shape of mounting plate 32 facilitates flexing of mounting plate 32 along middle portion 60, with mounting plate 32 bowing between first and second ends 56 and 58. Holes 54 receive bolts which thread into receivers 26 mounted on hopper 16. The flat profiles of first and second ends 62, 66 allows first end 62 to fit flush with electromagnetic coil 38 and second end 66 to sit flush with armature 40. The round, exaggerated curve of curved portion 64 distributes stress along curved portion 64 during flexing of resilient bracket 42 during the electromagnetic field cycle.

Legs 44, back panel 46, and feet 50 of amplifier bracket 30 add vibration to amplifier bracket 30 without requiring more power by integrating a flexible mass and spring into shaker assembly 28. Curved portion 64 allows for more deflection with less power needed for electromagnetic coil 38 and longer life due to less stress concentration on resilient bracket 42.

Figure 4:
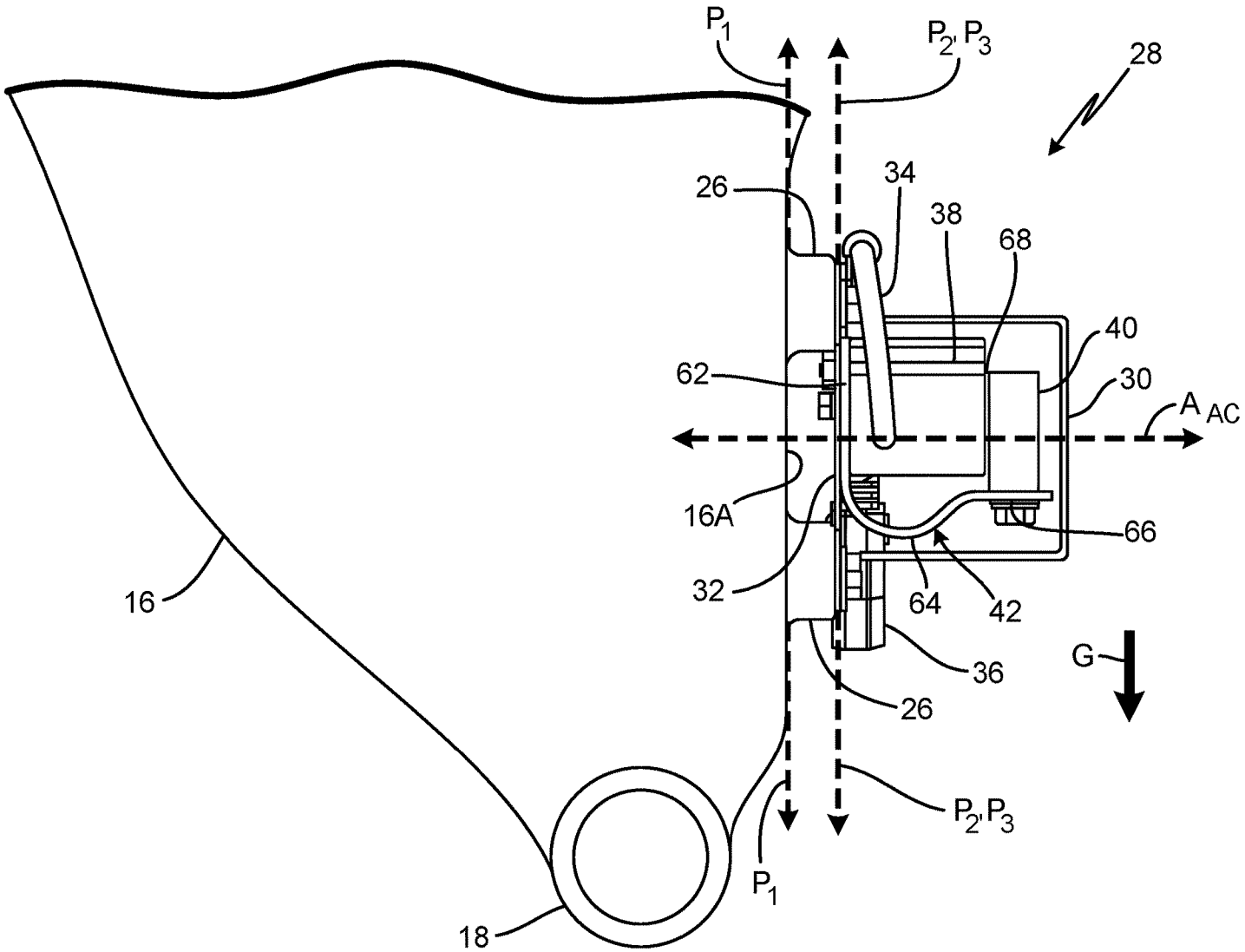
FIG. 4 is side view of a portion of the hopper and the shaker assembly.

FIG. 4 is side view of shaker assembly 28 mounted on to hopper 16 and shows hopper 16 (with sidewall 16A, port 18, and receivers 26), shaker assembly 28 (with amplifier bracket 30, mounting plate 32, electrical cord 34, receptacle 36, electromagnetic coil 38, armature 40, resilient bracket 42 (including first end 62, curved portion 64, and second end 66), and acceleration axis $A_{AC}$ of armature 40), gap 68, first plane $P_1$, second plane $P_2$, third plane $P_3$, and a general direction G of gravity.

In this non-limiting embodiment, resilient bracket 42 is thicker than mounting plate 32 and amplifier bracket 30. Acceleration axis $A_{AC}$ is a linear axis representative of a direction of motion of armature 40. Gap 68 is a space or air gap between electromagnetic coil 38 and armature 40. In some non-limiting embodiments, gap 68 is 1 millimeter to 1 centimeter. In other non-limiting embodiments, gap 68 can be smaller than 1 millimeter, greater than 1 centimeter, or can be zero. First plane $P_1$, second plane $P_2$, and third plane $P_3$ are flat, imaginary surfaces extending infinitely outwards. Direction G is a general direction of gravity relative to the orientation of hopper 16 as shown in FIG. 4.

Electromagnetic coil 38 and armature 40 are sandwiched between mounting plate 32 and amplifier bracket 30 along acceleration axis $A_{AC}$. Acceleration axis $A_{AC}$ is representative of the direction of motion of armature 40 during operation of shaker assembly 28. In this non-limiting embodiment, acceleration axis $A_{AC}$ of armature 40 is orthogonal to first plane $P_1$ of sidewall 16A of hopper 16. Gap 68 extends between portions of electromagnetic coil 38 and armature 40. Sidewall 16A extends along and in a direction of first plane $P_1$. Mounting plate 32 extends along and in a direction of second plane $P_2$. First end 62 of resilient bracket 42 extends along and in a direction of third plane $P_3$.

Gap 68 allows armature 40 to move toward electromagnetic coil 38 (along acceleration axis $A_{AC}$) before the electromagnetic field diminishes and the spring elements of the shaker assembly 28 (e.g., mounting plate 32, resilient bracket 42, and amplifier bracket 30) move armature 40 back towards a nominal position with respect to electromagnetic coil 38. In one non-limiting embodiment, armature 40 does not contact electromagnetic coil 38 during operation of shaker assembly 28, such that gap 68 is decreased but maintained during an operational cycle. In other non-limiting embodiments, gap 68 may be become closed during operational cycles such that armature 40 and electromagnetic coil 38 come into contact.

First plane $P_1$ of sidewall 16A is oriented orthogonal to acceleration axis $A_{AC}$. First plane $P_1$ of sidewall 16A is oriented generally parallel with second plane $P_2$, third plane $P_3$, and direction G of gravity. During operation of shaker assembly 28, armature 40 is accelerated toward (then away from) electromagnetic coil 38 along acceleration axis $A_{AC}$ during the electromagnetic field cycle. During the electromagnetic field cycle, armature 40 is accelerated directly toward mounting plate 32 and hopper 16 along acceleration axis $A_{AC}$. Accelerating armature 40 along acceleration axis $A_{AC}$ concentrates the vibratory force being transferred through mounting plate 32 to hopper 16 to boost the shaking effect on the contents of hopper 16.

Figure 5:
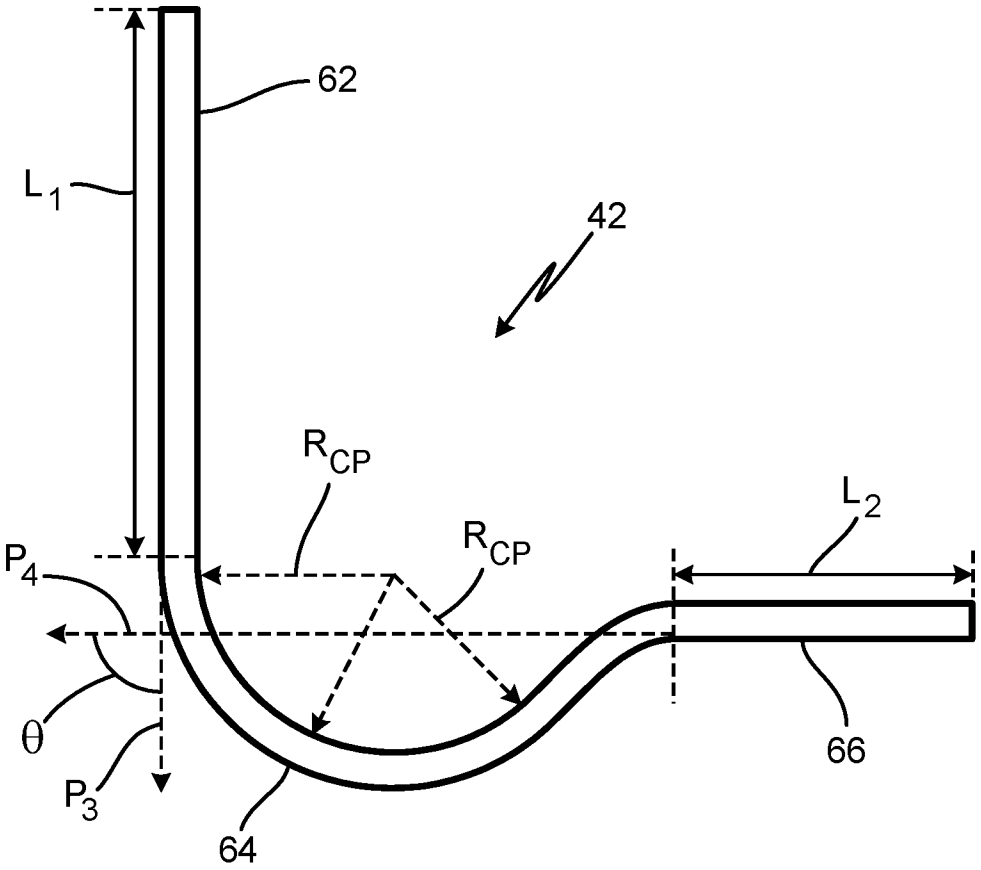
FIG. 5 is a cross section view of a resilient bracket of the shaker assembly.

FIG. 5 is a cross section view of resilient bracket 42 and shows first end 62, first length $L_1$, third plane $P_3$, curved portion 64, radius $R_{CP}$, second end 66, second length $L_2$, fourth plane $P_4$, and angle θ. First length $L_1$ is a length of first end 62. Radius $R_{CP}$ is a radius of curved portion 64. Second length $L_2$ is a length of second end 66. Fourth plane $P_4$ is a flat, imaginary surface extending infinitely outwards. Angle θ is an angle between two intersecting planes. Angle θ is representative of the angle between third plane $P_3$ of first end 62 and fourth plane $P_4$ of second end 66.

In this non-limiting embodiment, first length $L_1$ is greater than second length $L_2$ of second end 66 and greater than radius $R_{CP}$ of curved portion 64. In this non-limiting embodiment, radius $R_{CP}$ is approximately 50% to 100% of second length $L_2$ of second end 66. In other non-limiting embodiments, radius $R_{CP}$ can be less than 50% or greater than 100% of second length $L_2$ of second end 66. In this non-limiting embodiment, second length $L_2$ is greater than radius $R_{CP}$ of curved portion 64 and is less than first length $L_1$ of first end 62.

Fourth plane $P_4$ is oriented orthogonal to or 90 degrees from third plane $P_3$. A portion of curved portion 64 is out of plane with at least one of first end 62 and second end 66 such that a portion of curved portion 64 crosses over or extends across at least one of third plane $P_3$ and fourth plane $P_4$. In this non-limiting embodiment, angle θ between third plane $P_3$ of first end 62 is oriented approximately 90 degrees from fourth plane $P_4$ of second end 66.

Discussion of Possible Embodiments

The following are non-exclusive descriptions of possible embodiments of the present invention.

In a first example, a material sprayer includes a hopper and a shaker assembly mounted onto a sidewall of the hopper. The hopper includes at least one sidewall that extends along a first plane. The shaker assembly includes a resilient bracket, an electromagnetic coil, and an armature. The resilient bracket is mounted to the sidewall of the hopper and includes first and second ends and a curved portion. The electromagnetic coil is mounted to a portion of the resilient bracket and is configured to generate a magnetic field in response to a current from a power source. The armature is mounted to a portion of the resilient bracket such that the armature is able to move relative to the electromagnetic coil along an acceleration axis that is orthogonal to the first plane of the sidewall of the hopper.

In the first example, the material sprayer of the preceding paragraph can optionally include, additionally and/or alternatively, any one or more of the following features, configurations and/or additional components.

In the first example, the at least one sidewall can include a set of receivers, wherein each receiver can include a threaded recess.

In the first example, a mounting plate can be mounted to the sidewall of the hopper, wherein the mounting plate can extend in a second plane that can be parallel to the first plane of the sidewall.

In the first example, the mounting plate can comprise a first end, a second end, and/or a middle portion, wherein the middle portion can include a width that can be less than a width of both of the first and second ends of the mounting plate.

In the first example, a U-shaped bracket can be mounted to the mounting plate, wherein the U-shaped bracket can comprise two legs that can be disposed on opposite sides of the armature and/or of the electromagnetic coil.

In the first example, the U-shaped bracket can be configured to amplify and/or damp an amplitude of oscillation of the armature.

In the first example, the resilient bracket can comprise a first end, a second end, and/or a curved portion, wherein the first end of the resilient bracket can extend along a third plane that can be parallel to the first plane of the hopper sidewall and/or that can be orthogonal to the acceleration axis.

In the first example, a portion of the curved section of the resilient bracket can be out of plane with at least one of the first and second ends of the resilient bracket.

In the first example, the first end of the resilient bracket can extend along a third plane, wherein the second end of the resilient bracket can extend along a fourth plane, and/or wherein the third plane and the fourth plane can be oriented 90 degrees from each other.

In the first example, a portion of the curved portion can cross over or extend across at least one of the third plane and the fourth plane.

In a second example, a shaker assembly for a hopper of a material sprayer includes a resilient bracket, an electromagnetic coil, and an armature. The resilient bracket includes a first end, a curved section connected to the first end, and a second end attached to the curved section. A portion of the curved section is out of plane with at least one of the first end and the second end. The electromagnetic coil is mounted to a portion of the resilient bracket and is configured to generate a magnetic field in response to a current from a power source. The armature is mounted to a portion of the resilient bracket such that the armature is able to move relative to the electromagnetic coil.

In the second example, the shaker assembly of the preceding paragraph can optionally include, additionally and/or alternatively, any one or more of the following features, configurations and/or additional components.

In the second example, the first end of the resilient bracket can extend along a first plane, wherein the second end of the resilient bracket can extend along a second plane, and/or wherein the first plane and the second plane can be oriented 90 degrees from each other.

In the second example, a mounting plate can be mounted to the hopper, wherein the first end of the resilient bracket can be mounted to the mounting plate.

In the second example, a U-shaped bracket can be mounted to the mounting plate, wherein the U-shaped bracket can comprise two legs that can be disposed on opposite sides of the armature and/or of the electromagnetic coil.

In the second example, the U-shaped bracket can be configured to amplify or damp an amplitude of oscillation of the armature.

In the second example, the curved portion can include a partially circular shape with a radius, wherein the second end of the resilient bracket can include a length, wherein the radius of the curved portion can be 50 to 100% of the length of the second portion.

In a third example, a shaker assembly for a hopper of a material sprayer includes a mounting plate mounted to the hopper, a J-shaped bracket, an electromagnetic coil, an armature, and a U-shaped bracket. The J-shaped bracket includes a first end and a second end. The first end of the J-shaped bracket is mounted to the mounting plate. The electromagnetic coil is mounted to a portion of the J-shaped bracket and is configured to generate a magnetic field in response to a current from a power source. The armature is mounted to a portion of the J-shaped bracket such that the armature is able to move in an oscillating motion relative to the electromagnetic coil. The U-shaped bracket is mounted to the mounting plate and comprises two legs that are disposed on opposite sides of the armature and of the electromagnetic coil.

In the third example, the shaker assembly of the preceding paragraph can optionally include, additionally and/or alternatively, any one or more of the following features, configurations and/or additional components.

In the third example, the U-shaped bracket can be configured to amplify an amplitude of oscillation of the armature.

In the third example, the U-shaped bracket can be configured to damp an amplitude of oscillation of the armature.

In the third example, the mounting plate, the electromagnetic coil, the armature, the J-shaped bracket, and/or the U-shaped bracket can form a stack, wherein the U-shaped bracket can form a first end of the stack and/or the mounting plate can form a second end of the stack.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A material sprayer comprising:

a hopper with at least one sidewall, wherein the sidewall extends along a first plane;

a shaker assembly mounted onto the sidewall of the hopper, wherein the shaker assembly comprises:

a resilient bracket mounted to the sidewall of the hopper;

an electromagnetic coil mounted to a first portion of the resilient bracket, wherein the electromagnetic coil is configured to generate a magnetic field in response to a current from a power source; and an armature mounted to a second portion of the resilient bracket such that the armature is configured to move relative to the electromagnetic coil along an acceleration axis that is orthogonal to the first plane of the sidewall of the hopper.

2. The material sprayer of claim 1, wherein the at least one sidewall includes a set of receivers, wherein each receiver includes a threaded recess.

3. The material sprayer of claim 2, further comprising a mounting plate mounted to the sidewall of the hopper, wherein the mounting plate extends in a second plane that is parallel to the first plane of the sidewall.

4. The material sprayer of claim 3, wherein the mounting plate comprises a first end, second end, and middle portion, wherein the middle portion includes a width that is less than a width of both of the first and second ends of the mounting plate.

5. The material sprayer of claim 3, further comprising a U-shaped bracket mounted to the mounting plate, wherein the U-shaped bracket comprises two legs that are disposed on opposite sides of the armature and of the electromagnetic coil.

6. The material sprayer of claim 5, wherein the U-shaped bracket is configured to amplify or damp an amplitude of oscillation of the armature.

7. The material sprayer of claim 1, wherein the resilient bracket comprises a first end, a second end, and a curved portion, wherein the first end of the resilient bracket extends along a third plane that is parallel to the first plane of the hopper sidewall and that is orthogonal to the acceleration axis.

8. The material sprayer of claim 7, wherein a section of the curved portion of the resilient bracket is out of plane with at least one of the first and second ends of the resilient bracket.

9. The material sprayer of claim 8, wherein the first end of the resilient bracket extends along a third plane, wherein the second end of the resilient bracket extends along a fourth plane, and wherein the third plane and the fourth plane are oriented 90 degrees from each other.

10. The material sprayer of claim 9, wherein a portion of the curved portion crosses over or extends across at least one of the third plane and the fourth plane.

11. A shaker assembly for a hopper of a material sprayer, the shaker assembly comprising:

a resilient bracket configured to be hopper-mountable, the resilient bracket comprising:

a first end;

a curved section connected to the first end; and a second end attached to the curved section, wherein a portion of the curved section is out of plane with at least one of the first end and the second end;

an electromagnetic coil assembly directly mounted to and in contact with a first portion of the resilient bracket, wherein the electromagnetic coil assembly is configured to generate a magnetic field in response to a current from a power source; and an armature mounted to a second portion of the resilient bracket such that the armature is configured to move relative to the electromagnetic coil assembly.

12. The shaker assembly of claim 11, wherein the first end of the resilient bracket extends along a first plane, wherein the second end of the resilient bracket extends along a second plane, and wherein the first plane and the second plane are oriented 90 degrees from each other.

13. The shaker assembly of claim 11, further comprising a mounting plate mounted to the hopper, wherein the first end of the resilient bracket is mounted to the mounting plate.

14. The shaker assembly of claim 13, further comprising a U-shaped bracket mounted to the mounting plate, wherein the U-shaped bracket comprises two legs that are disposed on opposite sides of the armature and of the electromagnetic coil assembly.

15. The shaker assembly of claim 14, wherein the U-shaped bracket is configured to amplify or damp an amplitude of oscillation of the armature.

16. The shaker assembly of claim 11, wherein the curved portion includes a partially circular shape with a radius, wherein the second end of the resilient bracket includes a length, wherein the radius of the curved portion is 50 to 100% of the length of the second portion.

17. A shaker assembly for a hopper of a material sprayer, the shaker assembly comprising:

a first vibration-amplifying bracket configured to be mounted to the hopper;

a second vibration-amplifying bracket mounted to the first vibration-amplifying bracket, wherein the second vibration-amplifying bracket comprises a U-shaped bracket, wherein the second vibration-amplifying bracket further comprises a back panel and two legs each attached to opposite ends of the back panel;

an electromagnetic coil disposed between portions of the first and second vibration-amplifying brackets, wherein the electromagnetic coil is disposed fully within the second vibration-amplifying bracket and between the two legs; and an armature disposed between portions of the first and second vibration-amplifying brackets, wherein the armature is configured to move relative to the electromagnetic coil along an acceleration axis, wherein the armature is disposed within the second vibration-amplifying bracket and between the two legs.

18. The shaker assembly of claim 17, further comprising:

a J-shaped bracket with a first end and a second end, wherein the first end of the J-shaped bracket is mounted to the first vibration-amplifying bracket, and wherein:

the first vibration-amplifying bracket comprises a mounting plate;

the electromagnetic coil is mounted to a portion of the J-shaped bracket, wherein the electromagnetic coil is configured to generate a magnetic field in response to a current from a power source; and the armature is mounted to a portion of the J-shaped bracket such that the armature is able to move in an oscillating motion relative to the electromagnetic coil.

19. The shaker assembly of claim 17, wherein the U-shaped bracket is configured to amplify an amplitude of oscillation of the armature.

20. The shaker assembly of claim 18, wherein the mounting plate, the electromagnetic coil, the armature, the J-shaped bracket, and the U-shaped bracket form a stack, wherein the U-shaped bracket forms a first end of the stack and the mounting plate forms a second end of the stack.

* * * * *